United States Patent [19]

Tyer et al.

[11] 4,331,085

[45] May 25, 1982

[54] EXIT GAS CONTROL FOR FLAME STABILIZATION AND PERFORMANCE TUNING OF STARVED-AIR AUGER COMBUSTOR

[76] Inventors: Robert C. Tyer, Rte. 24, Box 600, Baldwin, Fla. 32234; Robert E. Fitch, 13262 SE. 261 St., Kent, Wash. 98031; Gordon H. Tucker, 1708 Franklin St., Enumclaw, Wash. 98022

[21] Appl. No.: 148,497

[22] Filed: May 9, 1980

[51] Int. Cl.[3] ..... F23J 15/00

[52] U.S. Cl. ..... 110/203; 110/210; 110/214; 432/59; 34/182

[58] Field of Search ..... 34/182; 110/203–205, 110/210–212, 214, 224, 227; 432/59

[56] References Cited

U.S. PATENT DOCUMENTS

| | | | |
|---|---|---|---|
| 3,289,318 | 12/1966 | Roos | 34/182 |
| 3,392,455 | 7/1968 | Kingsbaker, Jr. et al. | 34/182 |
| 3,942,455 | 3/1976 | Wallis . | |
| 4,037,543 | 7/1977 | Angelo . | |
| 4,116,620 | 9/1978 | Stibbe | 432/59 |
| 4,217,090 | 8/1980 | Whike et al. | 432/59 |

*Primary Examiner*—Henry C. Yuen

*Attorney, Agent, or Firm*—Finnegan, Henderson, Farabow, Garrett & Dunner

[57] ABSTRACT

An exit gas control apparatus for flame stabilization and performance tuning of a starved-air combustor includes a first air conduit communicating with the combustion chamber near the fuel inlet and a second conduit communicating with the combustion chamber near the residue outlet. A damper is provided to proportion the discharge of combustion gases entirely through the first conduit, entirely through the second conduit, or proportionately through the first conduit and the second conduit to enable the starved-air combustor to operate in full countercurrent, full co-current, or partial co-current and countercurrent modes, respectively.

2 Claims, 3 Drawing Figures

Fig. 2
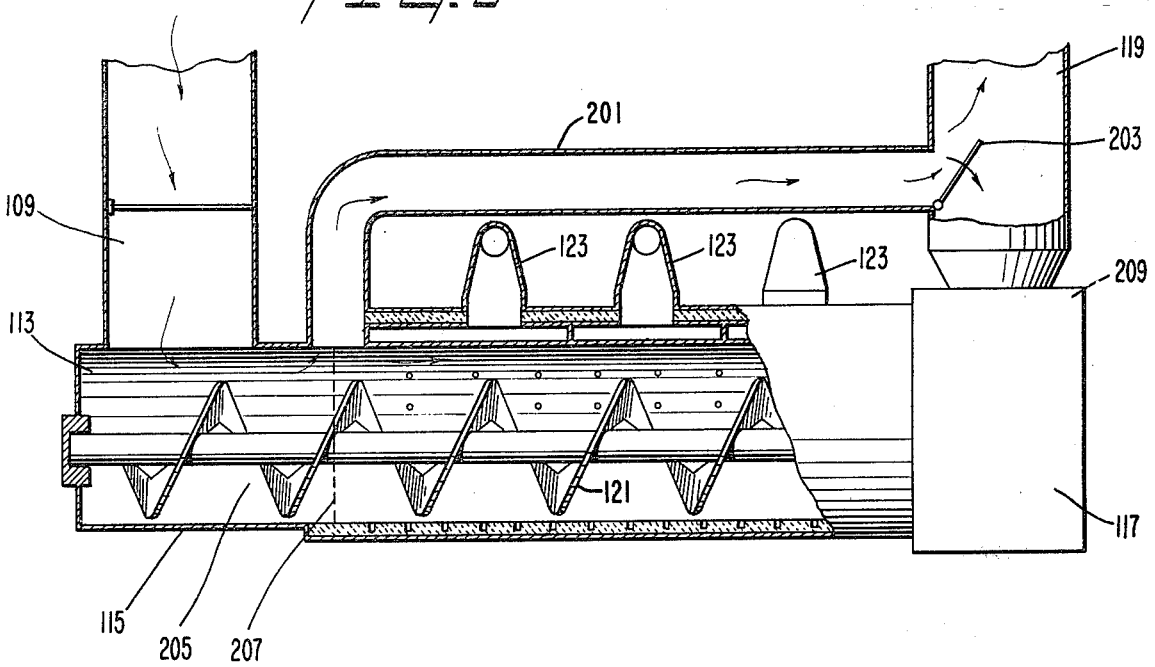
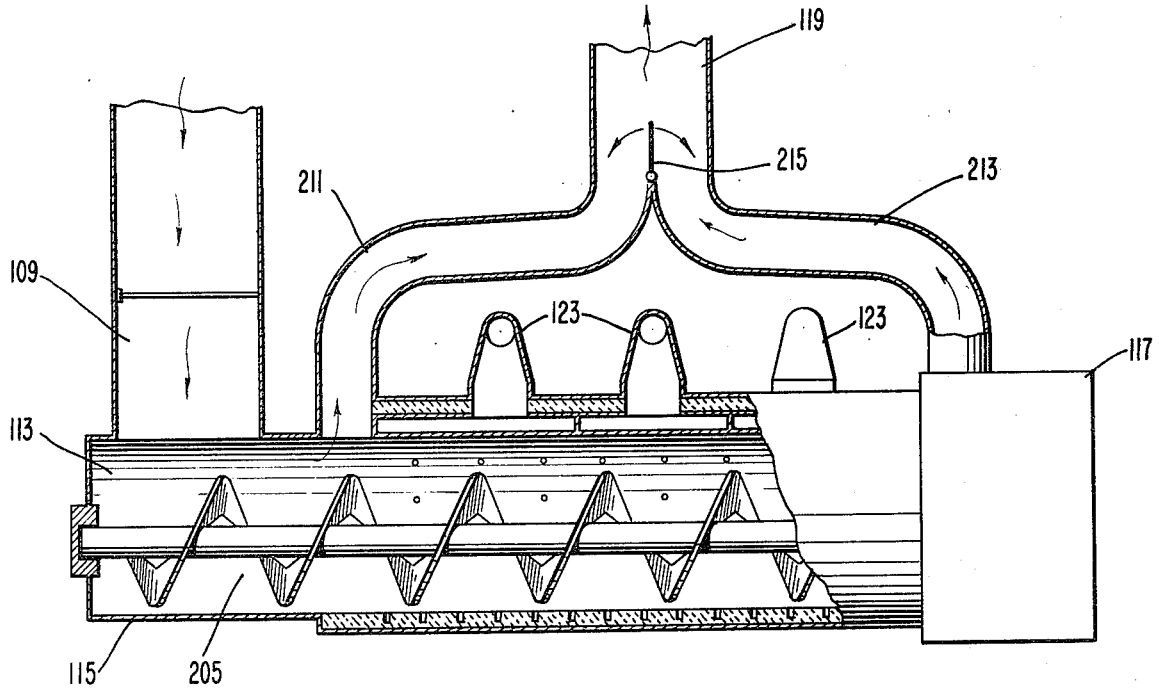
Fig. 3

EXIT GAS CONTROL FOR FLAME STABILIZATION AND PERFORMANCE TUNING OF STARVED-AIR AUGER COMBUSTOR

BACKGROUND OF THE INVENTION

In the last century, much of the world's energy needs have been fulfilled by hydrocarbon fuels which provided a convenient, plentiful, and inexpensive energy source. The current rising costs of such fuels and concerns over the adequacy of their supply in the future has made them a less desirable energy source and has led to an intense investigation of alternative sources of energy. The ideal alternative energy source is a fuel which is renewable, inexpensive, and plentiful, with examples of such fuels being the byproducts of wood, pulp, and paper mills, and household and commercial refuse.

The use of alternative energy sources is not problem-free, however, since there is a concern over the contents of the emissions from the combustion of such fuels as well as the environmental ramifications of acquiring and transporting the fuel and disposing of the residue of combustion.

One promising prior art device for using such alternative energy sources, while maintaining a high degree of environmental quality, is the starved-air combustor wherein the air supplied for combustion is controlled in order to control temperature conditions and the rates of combustion are controlled to consume the fuel entirely. Such starved-air combustors are capable of burning various types of fuel and producing significant amounts of heat which can be employed for any number of purposes including the production of process steam for use in manufacturing and in the generation of electricity.

Starved-air combustors, as previously known and operated, have not been entirely satisfactory in both entirely consuming the combustible elements of the fuel at high throughput while not producing noxious emissions. This problem results, in part, from the use of such starved-air combustors to burn a wide variety of fuels some of which may be non-homogeneous, e.g., household or commercial refuse. It has not been possible in the previously known starved-air combustors to tailor in a real time manner the combustion processes to the type of fuel being combusted in order to maximize the efficiency of the combustor while minimizing the generation of air pollutants. While the pollution problem can be solved to a degree by the utilization of scrubbers and other antipollution devices, such mechanisms are very expensive and their cost may militate against the use of alternative energy sources.

SUMMARY OF THE INVENTION

It is, therefore, an object of the present invention to provide a starved-air combustor capable of efficiently utilizing many different types and quantities of fuel.

Another object of this invention is to provide a starved-air combustor which does not release noxious pollutants into the atmosphere.

Yet another object of this invention is to provide a starved-air combustor which is capable of combusting to a very high degree the percentage of all combustible materials provided to it as fuel.

Still another object of this invention is to provide a starved-air combustor including means for selectively exhausting combustion gases from the combustion chamber in a direction co-current with the flow of fuel through the combustion chamber or countercurrent to the flow of fuel through the combustion chamber.

To achieve these objects, and in accordance with the purpose of the invention, as embodied and broadly described herein, the starved-air combustor comprises a combustion chamber having an inlet end for receiving fuel, the combustion chamber for combusting the received fuel to produce hot, combustion gases and combustion residue, the combustion chamber including an outlet end for discharging the combustion residue, means for conveying the fuel through the combustion chamber means from the inlet end toward the outlet end, first means for communicating with the combustion chamber proximate the inlet end of the combustion chamber for exhausting hot, evolved gases from the combustion chamber, second means communicating with the combustion chamber means proximate the outlet end of the combustion chamber means for exhausting hot, evolved combustion gases from the combustion chamber and means for controlling the exhausting of the combustion gases from the combustion chamber to exhaust selectively the evolved gases entirely through the second means or proportionately through the first means and the second means.

The accompanying drawings, which are incorporated in and constitute a part of this specification, illustrate an embodiment of the invention and, together with the description, serve to explain the principles of the invention.

BRIEF DESCRIPTION OF THE DRAWINGS

FIG. 2 is an enlarged cross-sectional, schematic view taken along lines 2—2 of FIG. 1 illustrating the means for exhausting combustion gases from the combustion chamber.

FIG. 3 is a schematic view of an alternate embodiment of the means for exhausting combustion gases from the combustion chamber.

DESCRIPTION OF THE PREFERRED EMBODIMENT

Figure 1:
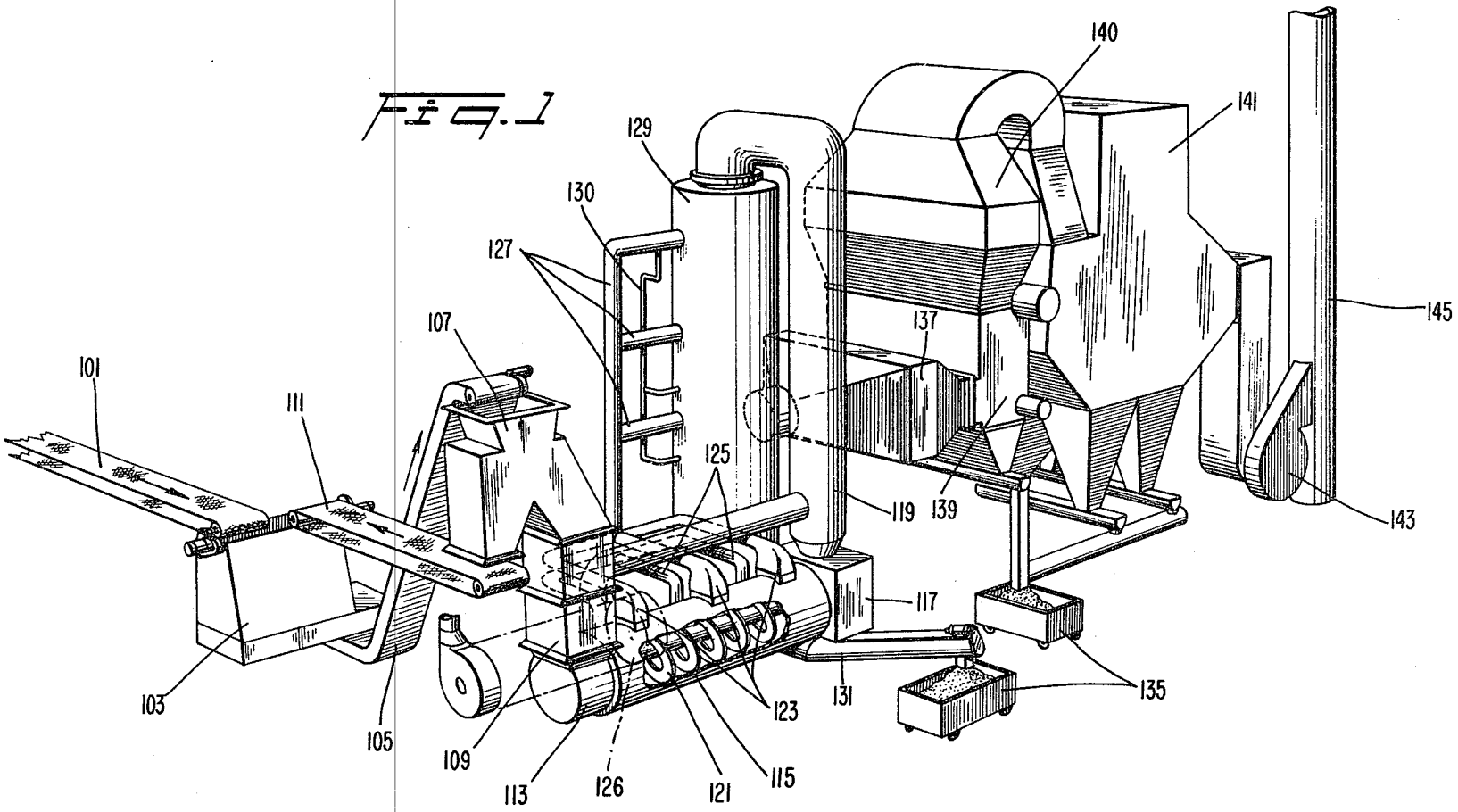
FIG. 1 is an illustration of the starved-air combustor of the instant invention coupled, for illustration, between a fuel supply system and a system which produces process steam from the heat produced by the starved-air combustor.

FIG. 1 illustrates an embodiment of a starved-air combustor, according to the present invention, coupled between a refuse feeder system and a steam generation system. As embodied herein, the refuse supply system comprises a supply conveyor 101 for conveying fuel, in this instance refuse, from a receiving building (not shown) and one or more storage silos (not shown). The receiving building and storage silos are to insure that an adequate supply of fuel can be supplied to the combustor in order to permit the combustor to run at peak efficiency. In the illustrated embodiment, it is contemplated that the supply conveyor 101 would supply fuel to the fuel surge and recirculation bin 103 at a rate of at least fifteen tons per hour and that the capacity of the combustor system would range from 150 to 500 pounds per minute.

The fuel surge and recirculation bin 103 comprises an additional means for insuring that a constant and adequate supply of fuel is available to the combustor. The bin 103 could, for example, contain at least 10 minutes capacity of fuel, i.e., approximately 2.5 tons, which is received at the top of the bin 103 and supplied through the bottom of the bin 103 to the feed conveyor 105. Feed conveyor 105 supplies the fuel to a splitter valve 107 which may either direct the fuel into the feed and weigh bin 109 or, when the feed and weigh bin 109 is filled to capacity, to the return conveyor 111 for return to the fuel surge and recirculation bin 103. The feed and weigh bin 109 is calibrated to supply a preset weight of fuel at the inlet end 113 of a refractory-lined combustor 115 at such time that the first flight of an auger or screw-conveyor 121 within the chamber 115 has been rotated into a fuel receiving position. Within the starved-air combustor 115 there is provided a well-known oil igniter (not shown) in the input end of the combustion chamber 115 which serves as a means for initially igniting the fuel upon start up of the starved air combustor.

U.S. Pat. No. 4,009,667 issued to Robert C. Tyer et al on Mar. 1, 1977, illustrates an appropriate embodiment for a rotatably-driven auger comprised of a rotatable, water-cooled horizontal shaft supporting a spiral flight of decreasing pitch from the input end of the auger to the output end. It is contemplated in the instant system that the speed of the auger would range from 0.3 to 1 rpm. An appropriate oil igniter would comprise an oil burner having its flame extending into the input end of the combustor 115 to heat and to ignite the initial load of fuel supplied by the feed and weigh bin 109. It is contemplated that such an oil igniter would be capable of burning oil fuel at a rate of approximately six gallons per hour at two pounds per square inch pressure.

The combustor 115 has an output end 117 connected to a conduit 119 which feeds the top of an afterburner 129. The combustor 115 also includes air supply means 123 for supplying underfire air and conduits 125 for supplying overfire air. This air is provided by a fan 126 (shown in phantom) which also supplies air through conduits 127 to the afterburner 129. Alternatively, a separate fan or fans may be provided to supply underfire air, overfire air, and air to the afterburner 129. A small air distributor 130 is connected to the upper conduit 127 to supply air into the afterburner 129 through special injectors located both at and below the midpoint of the afterburner 129.

Afterburner 129 is provided, in part, as a secondary combustor chamber which mixes the air supplied by the conduits 127 with the gaseous and entrained solid particle output of the combustor from the outlet end 117 to combust all combustible material in the gaseous output and, in part, to separate suspended ash and non-combustible solids from the hot non-combustible gas. Both the non-combustible material from the afterburner 129 and the combustion residue from combustor 115 are fed through conduit 131 to an ash collector 135. The hot non-combustible gas exits into a super-heater 137 from which it is supplied to a waste heat boiler 139 and economizer 140 to produce, in this case, process steam. An electrostatic precipitator 141 removes any additional solids from the now cooler non-combustible gas exiting from the waste heat boiler 139 through the economizer 140 and the solid material is conveyed to an ash cart 135. From the precipitator 141, the non-combustible gas is drawn by a fan 143 and expelled from stack 145. Upon entering into the fan 143 the temperature of the gas is approximately 300 to 400 degrees Fahrenheit and the fan 143 is of sufficient strength to exert a negative pressure in the system from the combustor 115, the afterburner 129, superheater 137, waste heat boiler 139, and precipitator 141.

The present invention is particularly concerned with an apparatus for selectively exhausting combustion gases from the combustion chamber through a first exhaust port located proximate the inlet end of the combustion chamber and a second exhaust port located proximate the outlet end of the combustion chamber. When the combustion gases are exhausted from the port located near the outlet end of the combustion chamber, the starved-air combustor is said to be operating in the co-current mode meaning that the exhaust gases are traveling in the same direction as the fuel within the combustion chamber. Conversely, when the combustion gases are exhausted through the exhaust port located near the inlet end of the combustion chamber, the starved-air combustor is said to be operating in the countercurrent mode meaning that the exhaust gases are traveling against the direction of flow of fuel through the combustion chamber.

It is possible, by controlling the co-current and countercurrent exhaustion rates to both position and stabilize the flame front in the fuel bed within the combustion chamber 115. Full co-current exhaustion tends to establish the flame front closer to the outlet end 117 of the combustor 115 whereas full countercurrent exhaustion tends to establish the flame front proximate the inlet end 113. The ability to establish and stabilize the flame front is an important feature of the present invention because it is desirable to tailor the length of the flame bed to the type and condition of the fuel being combusted. For example, if the fuel is quite wet, it may be desirable to permit a lesser drying and heating distance for the fuel to travel before reaching the flame front.

As illustrated in the previously cited Tyer et al patent, the combustion chamber is supplied with overfire air, i.e., air injected into the combustion chamber above the fuel, and underfire air which is air injected into the combustion chamber from beneath the fuel bed in the combustion chamber. The progression of events transpiring between the entry of the fuel at the inlet end of the combustion chamber, the travel of the fuel through the combustion chamber while it is being combusted, and the evolution of combustion gases and combustion residue is well-known in the art of starved-air combustors. Generally, the water and the fuel are first evaporated and then, before the fuel reaches the ignition point, the cellulosic, plastic, and rubber materials begin to decompose as their temperatures increase and evolve volatile gases including heavy tars and acids. After the volatile gases are evolved, carbon particles begin to be produced and the presence of the overfire air causes the carbon particles and the tars to be combusted in the combustion chamber.

These processes all occur as the fuel travels from the inlet end of the combustion chamber toward the outlet end of the combustion chamber and, therefore, the gases near the inlet end of the combustion chamber contain a higher concentration of water, tars, and acids since they have not yet passed over the entire flame bed within the combustion chamber. Conversely, the gases present near the outlet end of the combustion chamber had a longer period of time to be mixed with the overfire air to combust further any combustible materials therein. As a result, the combustion gases near the outlet end of the combustion chamber include an increased concentration of carbon monoxide, carbon dioxide, and hydrogen and a decreased concentration of unreacted fuel chemical fragments.

Similarly, combustion gases exhausted near the inlet end of the combustion chamber will be at a lower temperature than combustion gases exhausted near the outlet end of the combustion chamber. This is because much of the heat in the combustion gases is absorbed by the commonly cool and wet fuel which is received at the inlet end. The passage of the hot exhaust gases through the fuel bed causes the fuel to evolve tars, acids, and water vapor and thus contain a higher concentration of combustible materials and other pollutants.

Gases that are exhausted near the outlet end of the combustion chamber will be significantly higher in temperature since the last process to which they are subject is mixture with over-fire air and further combustion of the combustible materials.

The present invention is directed to a means for selectively enabling the starved-air combustor to operate in a full co-current mode, a full countercurrent mode, or proportionally in both a co-current and countercurrent mode.

As illustrated in FIG. 2, the starved-air combustor comprises a combustion chamber formed, for example, from a cylindrical combustion chamber 115 having an inlet end 113 and an outlet end 117. Within the combustion chamber 115, a bed of fuel 205 is conveyed by a conveying means from the inlet end toward the outlet end. As embodied herein, the conveying means comprises a rotatable auger 121 extending eccentrically through the cylindrical combustion chamber 115 to provide a space at the top for the mixing of overfire air 123 and combination gases. A flame front 207 illustrates an example of where the ignition point of the fuel bed 205 is within the combustion chamber 115. The fuel from the flame front 207 toward the outlet end 117 is at a temperature at or above the ignition point of the fuel in the bed 205.

The starved-air combustor further includes first means communicating with the combustion chamber proximate to the inlet end 113 for exhausting hot, combustion gases evolved from the combustion of the fuel within the combustion chamber 115. The starved-air combustor further includes second means communicating with the combustion chamber 115 proximate to the outlet end 117 for also exhausting hot combustion gases evolved from the combustion of the fuel in the combustion chamber 115.

As embodied herein, the first means comprises a first conduit 201 coupled at one end to the interior of the combustion chamber 115 and coupled at its other end to the duct 119 which leads to the afterburner 129. The second means comprises a second conduit 209 constituting the lower portion of the duct 119 which communicates with the interior of the combustion chamber 115 near the outlet end 117.

The starved-air combustor further includes means for controlling the exhausting of the evolved gases from the combustion chamber to exhaust selectively the evolved gases entirely through the conduit 209 or proportionally through the conduit 201 and the conduit 209. As embodied herein, the controlling means comprises a manually-positionable damper 203 located at the intersection of the conduit 201 and the duct 119 and having a length sufficient to seal completely the intersection of the conduit 201 and the duct 119 when the damper 203 is positioned in a vertical position and to restrict partially the communication of conduit 209 with the duct 119 when the damper is rotated into the horizontal position. As illustrated in FIG. 2, the damper has been positioned to permit exhaustion of the gases through both the conduit 201 and the conduit 209 to enable the selective balancing of co-current and countercurrent flow of combustion gases in the combustion chamber 115.

FIG. 3 illustrates an alternate embodiment of the first and second exhausting means and the controlling means. As illustrated in FIG. 3, the first means and the second means comprise first and second conduits 211 and 213, respectively, which intersect at the location of the damper 215. The damper is selectively positionable to control the flow of exhaust gases through the conduit 211 or the conduit 213 into the exhaust gas collector or duct 119. As was the case with the embodiment illustrated in FIG. 2, the overfire air and underfire air supplied to the combustion chamber together with the draft of the fan 143 (FIG. 1) causes an inherent flow of combustion gases from the combusting fuel in the fuel bed 205 out of the combustion chamber 115.

It will be further apparent to those skilled in the art, that various modifications and variations can be made to the exhaust gas flow control means of the starved-air combustor without departing from the scope or spirit of the invention and it is intended that the present invention cover the modifications and variations of the system provided that they come within the scope of the appended claims and their equivalents.

What is claimed is:

1. A starved-air combustor comprising:

a combustion chamber having an inlet end for receiving fuel, said combustion chamber for combusting said received fuel to produce hot, combustion gases and combustion residue, said combustion chamber including an outlet end for discharging said combustion residues;

means for conveying said fuel through said combustion chamber from said inlet end towards said outlet end;

an exhaust gas collector;

a first conduit communicating with said combustion chamber proximate said inlet end of said combustion chamber and with said exhaust gas collector for exhausting said hot, combustion gases from said combustion chamber to said exhaust gas collector;

a second conduit communicating with said combustion chamber proximate said outlet end of said combustion chamber and with said exhaust gas collector for exhausting said hot, combustion gases from said combustion chamber to said exhaust gas collector; and means for controlling the exhausting of said combustion gases from said combustion chamber to exhaust selectively said evolved gases entirely through said second means or proportionately through said first means and said second means, said controlling means comprising a rotatable damper in said exhaust gas collector positionable in a first orientation to completely block the exhaustion of said combustion gases through said first conduit and to permit the complete exhaustion of said combustion gases through said second conduit, a second orientation to partially block the exhaustion of said combustion gases through said second conduit and to permit the partial exhaustion of said combustion gases through said first conduit, and a plurality of third orientations intermediate said first orientation and said second orientation, each of said third orientations for permitting the proportional exhaustion of said combustion gases from said combustion chamber through said first conduit and said second conduit.

2. A starved-air combustor according to claim 1 wherein said damper is manually positionable.

* * * * *